US006113304A

United States Patent [19]

Tremoulet, Jr. et al.

[11] Patent Number: 6,113,304

[45] **Date of Patent: *Sep. 5, 2000**

[54] COUPLING FOR HIGH PRESSURE FLUID PUMP ASSEMBLY

[75] Inventors: Olivier L. Tremoulet, Jr., Edmonds; Chidambaram Raghavan, Kent, both of Wash.

[73] Assignee: Flow International Corporation, Kent, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/936,496

[22] Filed: Sep. 18, 1997

[51] Int. Cl.[7] ..... F16J 1/00

[52] U.S. Cl. ..... 403/301; 403/26; 403/31; 403/304; 74/582; 92/84

[58] Field of Search ..... 92/168 R, 84; 403/300, 301, 303, 304, 306, 26, 31; 74/582; 251/77

[56] References Cited

U.S. PATENT DOCUMENTS

| | | | |
|---|---|---|---|
| 1,443,675 | 1/1923 | Bowler | 137/540 |
| 2,059,759 | 11/1936 | Stearns | 137/153 |
| 2,429,578 | 10/1947 | Gleasman | 251/144 |
| 3,550,617 | 12/1970 | Johnson | 137/514.5 |
| 3,776,558 | 12/1973 | Maurer et al. | 277/9 |
| 4,099,762 | 7/1978 | Hultdin et al. | 403/31 X |
| 4,101,099 | 7/1978 | Hickle | 403/31 X |
| 4,103,849 | 8/1978 | Holt et al. | 403/31 X |
| 4,350,179 | 9/1982 | Bunn et al. | 137/540 |
| 4,448,574 | 5/1984 | Shimizu | 417/488 |
| 4,620,562 | 11/1986 | Pacht | 137/315 |
| 4,637,419 | 1/1987 | Hughes | 251/77 X |
| 5,127,807 | 7/1992 | Eslinger | 417/360 |
| 5,493,954 | 2/1996 | Kostohris et al. | 92/168 |
| 5,564,469 | 10/1996 | Tremoulet, Jr. et al. | 137/540 |
| 5,692,851 | 12/1997 | Pace | 403/31 |
| 5,787,793 | 8/1998 | Niwa et al. | 92/168 R X |

FOREIGN PATENT DOCUMENTS

| | | |
|---|---|---|
| 368391 | 3/1929 | Belgium . |
| 0 391 488 A2 | 10/1990 | European Pat. Off. . |
| 0870956A1 | 10/1998 | European Pat. Off. . |
| 1057367 | 5/1952 | France . |
| 2 342 412 | 9/1977 | France . |
| 3538307A1 | 10/1984 | Germany . |
| 3534149C1 | 1/1987 | Germany . |
| 58-221081 | 12/1983 | Japan . |
| 5333941 | 12/1993 | Japan . |
| 1 407 874 | 10/1975 | United Kingdom . |
| 2216942A | 10/1989 | United Kingdom . |

*Primary Examiner*—Lynne H. Browne
*Assistant Examiner*—John R. Cottingham
*Attorney, Agent, or Firm*—Seed, I.P. Law Group, PLLC

[57] ABSTRACT

A coupling for a high pressure fluid seal assembly is shown and described. The coupling includes a first member having first and second opposite ends and capable of motion along a first axis extending between the first and second ends. The first member has an engagement portion positioned toward the first end having a rounded convex engagement surface. The coupling further includes a second member also having first and second opposite ends and capable of motion along a second axis extending between the first and second ends of the second member. A second engagement portion toward the second end of the second member has a substantially flat second engagement surface engaging the first engagement surface of the first member. The interface between the first and second engagement surfaces aligns motion of the first member along the first axis with motion of the second member along the second axis. The coupling accordingly reduces the tendency for either the first or second member to bend. The coupling assembly further reduces the tendency for the first and second members to move laterally relative to their respective longitudinal axis.

31 Claims, 3 Drawing Sheets

COUPLING FOR HIGH PRESSURE FLUID PUMP ASSEMBLY

TECHNICAL FIELD

This invention relates to high pressure fluid pumps, and more particularly, to couplings for pumps having reciprocating plungers.

BACKGROUND OF THE INVENTION

In high pressure fluid pumps having reciprocating plungers, it is necessary to provide a seal around the plunger to prevent the leakage of high pressure fluid. In such pumps, the seal must be able to operate in a high pressure environment, withstanding pressures in excess of 10,000 psi, and even up to and beyond 50,000–70,000 psi.

Currently available seal designs for use in such an environment include an extrusion resistant seal supported by a back-up ring, the back-up ring and seal being held by a seal carrier. However, the tolerances for clearance between the plunger and back-up ring are very difficult to achieve and maintain. Very typically, therefore, the plunger and back-up ring come into contact, generating frictional heating, which in turn causes the seal to fail.

A further drawback associated with current pump and seal designs is that the plunger may be misaligned with an extension rod to which it is coupled and which imparts a linear reciprocal motion to the plunger. The misalignment may cause the plunger to create unnecessary wear on parts such as the seal, which contact the plunger as it reciprocates. The misalignment may also cause the plunger to bend and ultimately break.

Accordingly, there is a need in the art for an improved high pressure seal and plunger assembly, and in particular, an assembly that is simple to manufacture accurately, that will increase the life of the seal and that will align the plunger with the seal and with the driver to which it is coupled. The present invention fulfills these needs, and provides further related advantages.

SUMMARY OF THE INVENTION

Briefly, the present invention provides an improved coupling between a first member of an ultra-high pressure pump moving axially along a first axis and a second member of the ultra-high pressure pump moving axially along a second axis. In a preferred embodiment, the coupling includes a first member having first and second opposite ends and capable of axial motion along a first axis extending between the first and second ends. The first member has a first engagement portion positioned toward the first end, the first engagement portion having a rounded, convex first engagement surface. The coupling further includes a second member, also having first and second opposite ends and capable of motion along a second axis extending between the first and second ends of the second member. A second engagement portion toward the second end of the second member has a substantially flat second engagement surface engaging the first engagement surface of the first member. The interface between the first and second engagement surfaces aligns motion of the first member along the first axis with motion of the second member along the second axis.

In another embodiment, the first member passes through a bore of a seal carrier. The seal carrier has a first annular groove that is concentric with the bore and that carries an annular seal, an end region of the seal being supported by the seal carrier. The seal carrier has an integral annular guidance bearing that is positioned in a second annular groove of the seal carrier, the second annular groove and guidance bearing contained therein being concentric with the bore and being axially spaced from the first annular groove and seal. The bore through the seal carrier is therefore defined by an internal circumference of the guidance bearing, an internal circumference of the seal, and an inner region of the seal carrier positioned between the seal and the guidance bearing. An inner diameter of the guidance bearing is smaller than the inner diameter of the bore of the seal carrier in the region between the seal and the guidance bearing, thereby preventing the first member from contacting the seal carrier. In this manner, the seal is supported by the seal carrier, and the seal carrier is separated from the first member by the guidance bearing, thereby reducing frictional heating and extending the life of the seal. Also, the materials for the guidance bearing and first member are selected to minimize the friction between the two elements.

DETAILED DESCRIPTION OF THE INVENTION

Figure 1:
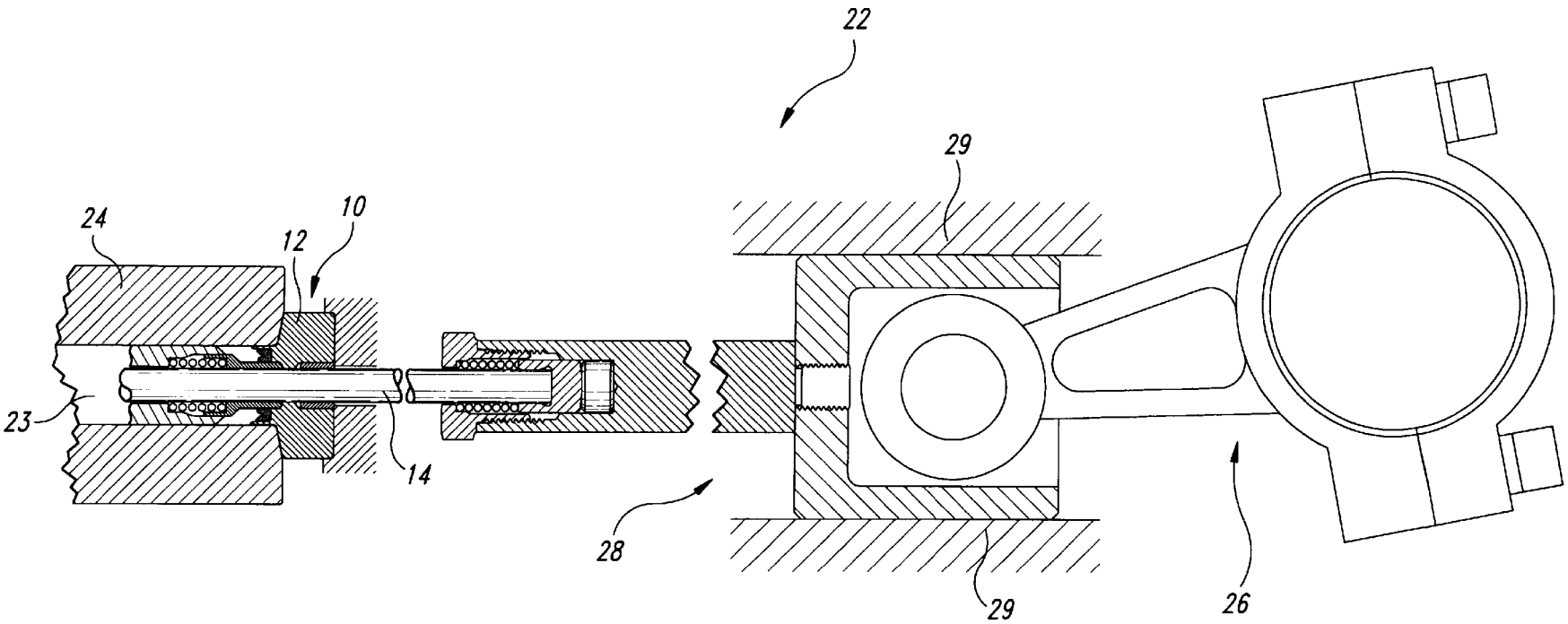
FIG. 1 is a cross-sectional plan view of a pump assembly incorporating a seal assembly and coupling provided in accordance with a preferred embodiment of the present invention.

An improved high pressure fluid seal assembly 10 is provided in accordance with a preferred embodiment of the present invention, as illustrated in FIG. 1. The seal assembly 10 is for use in a high or ultra-high pressure pump assembly 22 having a reciprocating plunger or first member 14 coupled with an extension rod or second member 28 to a drive mechanism 26. The plunger 14 reciprocates in a high pressure cylinder 24, the seal assembly 10 preventing the leakage of high pressure fluid from a high pressure region 23 within the high pressure cylinder 24.

Figure 2:
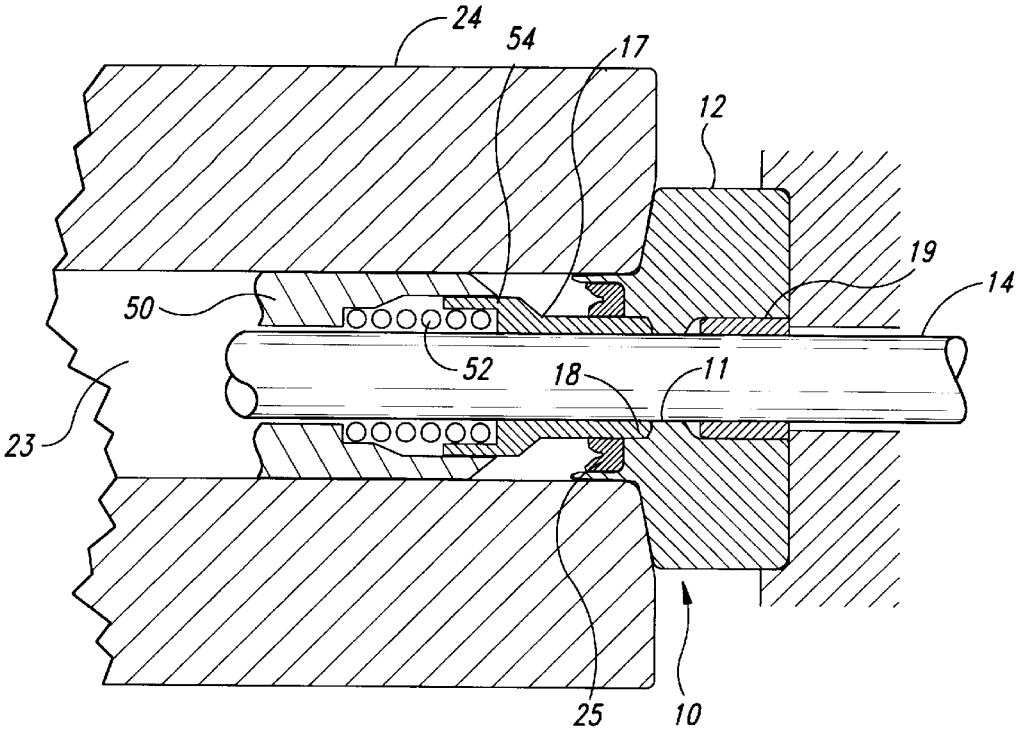
FIG. 2 is an enlarged cross-sectional plan view of the seal assembly illustrated in FIG. 1.
Figure 3:
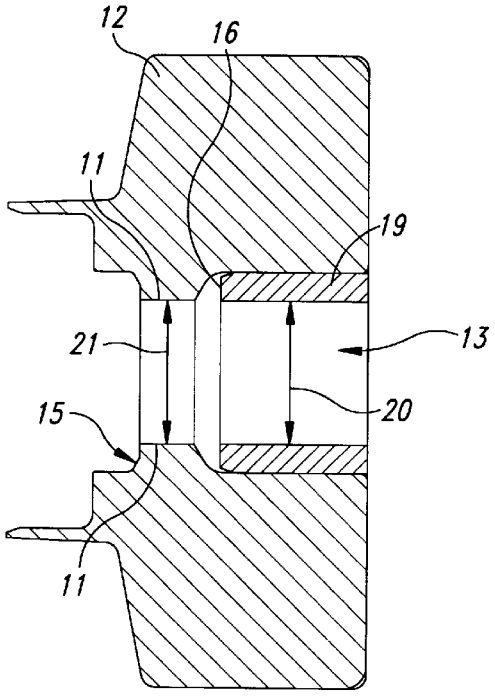
FIG. 3 is a cross-sectional plan view of an element of the seal assembly illustrated in FIGS. 1 and 2.

More particularly, as illustrated in FIGS. 2 and 3, the seal assembly 10 includes a seal carrier 12 having a bore 13 through which the reciprocating plunger 14 passes. The seal carrier 12 has a first annular groove 15 in which an annular seal 17 is positioned. An annular elastomeric seal 25 is provided around the outer circumference of annular seal 17, to engage the annular seal 17 during the start of a pressure stroke. A bushing 50 positioned within the high pressure region 23 houses a spring 52 which engages the annular seal 17 and urges it toward the first annular groove 15 to substantially prevent the annular seal from moving out of the first annular groove. The annular seal 17 has a flange portion 54 which engages the spring 52 and substantially prevents the spring from moving laterally into contact with the plunger 14. The seal carrier 12 also has an integral, annular guidance bearing 19, which is positioned in a second annular groove 16 within the bore 13. As seen in FIG. 3, the second annular groove 16 and guidance bearing 19 positioned therein are axially spaced from the first annular groove 15 and annular seal 17 contained therein.

The inner diameter 20 of the guidance bearing 19 is smaller than the inner diameter 21 of the seal carrier bore 13 in a region 11 between the seal 17 and guidance bearing 19. For example, in a preferred embodiment, the inner diameter 20 is 0.0005–0.0015 inch smaller than the inner diameter 21. In this manner, the end region 18 of annular seal 17 is supported by region 11 of the seal carrier 12; however, region 11 of seal carrier 12 is not in contact with the plunger 14, given the configuration of the guidance bearing 19.

A seal assembly 10 provided in accordance with a preferred embodiment of the present invention therefore supports a seal 17 directly by the seal carrier 12, eliminating the need for a back-up ring. The integral guidance bearing 19 prevents the plunger 14 from contacting the seal carrier 12, thereby reducing the frictional heating in the vicinity of the seal 17, which in turn extends the life of the seal. To further increase the longevity of the assembly 10, the component materials are selected to minimize the friction between the plunger 14 and the guidance bearing 19 and between the plunger 14 and the seal 17. In a preferred embodiment, the plunger 14 is made of partially stabilized zirconia ceramic, the guidance bearing 19 is made of a resin impregnated graphite, and the seal 17 is made of an ultra-high molecular weight polyethylene. However, it should be noted that a variety of materials may be used, and the selection of the materials for the components are interdependent.

To further increase the reliability of the seal, the seal assembly is preferably manufactured by placing the guidance bearing 19 into the seal carrier 12, and machining the bore through the guidance bearing and through region 11 of the seal carrier in the same machining setup. As discussed above, the inner diameter of the bore in region 11 is machined slightly larger than the inner diameter 20 of the bore through the guidance bearing. However, by machining both areas in the same setup, the concentricity of the elements is improved, as compared to prior art systems wherein elements of a seal assembly are machined independently and then assembled.

The plunger 14 passes through and is piloted by the guidance bearing 19, to substantially prevent lateral motion of the plunger. The plunger is connected with the extension rod 28 to the drive mechanism 26 as discussed previously with reference to FIG. 1. The extension rod 28 is piloted near the drive mechanism by walls 29 which slideably engage a portion of the extension rod to substantially prevent lateral motion thereof.

Figure 4:
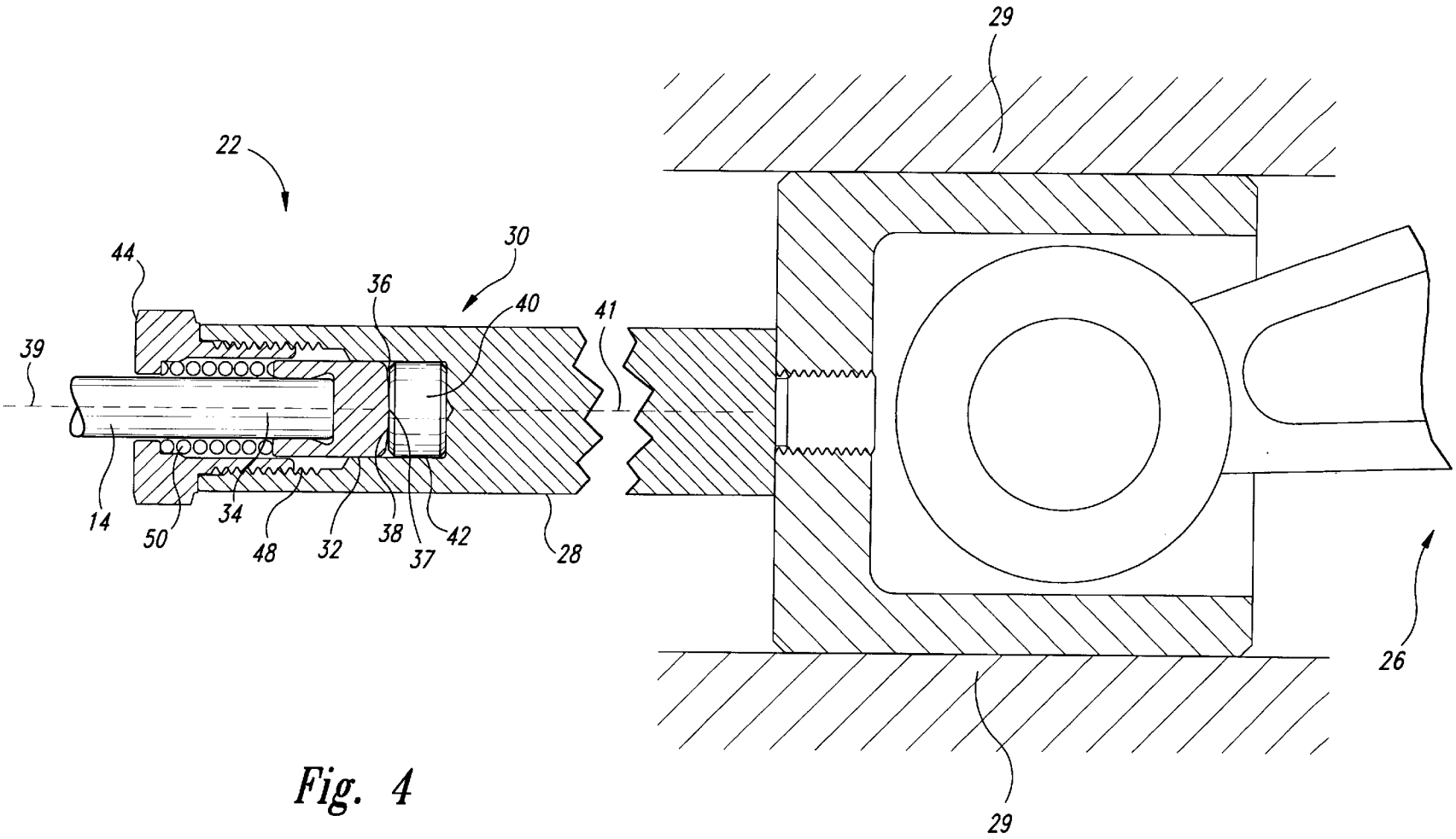
FIG. 4 is an enlarged cross-sectional plan view of the coupling illustrated in FIG. 1.

As shown in greater detail in FIG. 4, the extension rod 28 and plunger 14 are connected with a coupling 30. The coupling 30 includes a first bearing member or collar 32 which is press fit on an end portion 34 of the plunger 14. The first bearing member 32 includes a first engaging surface 36 which is convex so that it tends to bulge outwardly away from the plunger 14. An outermost portion 37 of the first engaging surface 36 is aligned with a plunger axis 39 along which the plunger 14 travels. In a preferred embodiment, the convex shape of the engaging surface 36 of the first bearing member 32 is spherical. In other embodiments, other shapes are used so long as the outermost portion 37 is aligned with the plunger axis 39. In one such alternate embodiment, the engaging surface 36 is conical such that the outermost portion 37 is the apex of a nearly flat cone aligned with the plunger axis 39.

In a preferred embodiment, the first bearing member 32 comprises hardened stainless steel. In a further preferred embodiment, the first bearing member 32 is easily removable from the end portion 34 and may accordingly be easily replaced when worn. In an alternate embodiment, the first bearing member comprises an integral portion of the plunger 14.

The first engaging surface 36 of the first bearing member 32 engages a corresponding second engaging surface 38 of a second bearing member 40 which bears against the extension rod 28. The extension rod 28 reciprocates along a rod axis 41. In a preferred embodiment, the second engaging surface 38 is flat and substantially perpendicular to the plunger axis 39 so as to engage only the outermost portion 37 of the first engaging surface and transmit motion and forces to the plunger 14 only along the plunger axis 39. Accordingly, the plunger and rod axes 39 and 41 are preferably coaxial to reduce the likelihood that non-axial forces will be generated at the interface between the plunger 14 and the extension rod 28.

In a preferred embodiment, the second bearing member 40 is housed within an aperture 42 of the extension rod 28. In other embodiments, the second bearing member 40 is coupled to the extension rod 26 with other means which permit the second engaging surface 38 to engage the first engaging surface 36. In a preferred embodiment, the second bearing member is formed from a hardened tool steel and is easily removable from the aperture 42 so that it may be replaced when worn. In an alternate embodiment, the second bearing member comprises an integral portion of the extension rod 28.

As shown in FIG. 4, the plunger 14 and extension rod 28 are connected so that as the extension rod 28 is drawn away from the plunger 14 by the drive mechanism 26, the plunger follows. In a preferred embodiment, the plunger 14 and extension rod 28 are coupled with a retaining nut 44 which is threadedly engaged with the extension rod. The retaining nut 44 is threaded into engagement with threads 48 positioned in the aperture 42 of the extension rod 28. The plunger 14 is accordingly piloted relative to the extension rod 28 and by the seal 19 to move axially along the plunger axis 39. The extension rod is accordingly piloted relative to the plunger 14 and by the walls 29 to move axially along the rod axis 41. A spring 50 biases the first bearing member 32 against the second bearing member 40 to ensure contact between the bearing members as the extension rod 28 reciprocates back and forth. In alternate embodiments, alternate means are used to connect the plunger 14 to the extension rod 28. In further alternate embodiments, a connection between the two is not required, so long as the plunger 14 and extension rod 28 are piloted relative to each other so that the plunger axis 39 and rod axis 41 are coaxial.

An advantage of the coupling 30 shown in the figures is that the corresponding shapes of the first and second bearing members align the forces generated in the extension rod 28 with the direction of travel of the plunger 14 and vice versa, reducing the likelihood that the plunger 14 or extension rod 28 will bend away from their respective travel directions. Another advantage of the coupling 30 is that by aligning the forces generated by the extension rod 28 with the motion of the plunger 14, and vice versa, the tendency for either the plunger or the extension rod to travel in a non-axial or lateral manner away from the plunger axis 39 or the rod axis 41 is reduced. By reducing lateral motion of the plunger 14, unnecessary wear on the guide bearing 19 and seal 17 is reduced. A further advantage of the coupling 30 is that the bearing members 32 and 40 may be removably attached to the plunger 14 and extension rod 28, respectively. If either bearing member becomes excessively worn during the course of normal use, it may easily be replaced without requiring that the entire plunger 14 or entire extension rod 28 be replaced.

An improved high pressure fluid seal and coupling assembly has been shown and described. From the foregoing, it will be appreciated that, although specific embodiments of the invention have been described herein for purposes of illustration, various modifications may be made without deviating from the spirit of the invention. Thus, the present invention is not limited to the embodiments described herein, but rather as defined by the claims which follow.

What is claimed is:

1. A high pressure fluid seal assembly for use in an ultrahigh pressure pump comprising:

a seal carrier having a bore therethrough and having a first annular groove concentric with the bore and a second annular groove concentric with the bore and axially spaced from the first annular groove;

an annular seal positioned in the first annular groove, an end region of the seal being supported by the seal carrier;

an annular guidance bearing positioned in the second annular groove, an inner diameter of the annular guidance bearing being smaller than an inner diameter of the bore of the seal carrier in a region between the first annular groove and the second annular groove;

a first member extending through the bore, having first and second opposite ends, elongated along a first longitudinal axis extending between and beyond the first and second ends and having a first engagement portion toward the first end, the first engagement portion having a first engagement surface rounded convexly away from the second end with a portion of the first engagement surface furthest from the second end aligned with the first longitudinal axis, the first member being piloted toward the first and second ends thereof for motion along the first longitudinal axis;

a second member having first and second opposite ends, elongated along a second longitudinal axis extending between and beyond the first and second ends of the second member, the second longitudinal axis being substantially coaxial with the first longitudinal axis, the second member being piloted toward the first and second ends thereof for motion along the second longitudinal axis, the second member having a second engagement portion toward the second end with a substantially flat second engagement surface in contact with the portion of the first engagement surface furthest from the second end of the first member and substantially perpendicular to the first longitudinal axis to align motion of the first member along the first longitudinal axis with motion of the second member along the second longitudinal axis.

2. The fluid seal of claim 1 wherein the first engagement portion of the first member is removably coupled thereto.

3. The fluid seal of claim 1 wherein the second engagement portion of the second member is removably coupled thereto.

4. The fluid seal of claim 1 wherein the bore is a first bore, the second member having a second bore extending into the second end along the second longitudinal axis and the second engagement portion includes a bearing member removably positioned within the second bore.

5. The fluid seal of claim 1 wherein the first engagement portion of the first member includes a collar removably coupled to the first member toward the first end and having an attachment portion extending at least partially around the first member and connected to the first member toward the first end.

6. The fluid seal of claim 1 wherein at least one of the first and second engagement portions is biased toward the other of the first and second engagement portions with a biasing member.

7. The fluid seal of claim 6 wherein the biasing member includes a coil spring biasing the first engagement member toward the second.

8. A coupling for transmitting linear motion in an ultrahigh pressure pump, the coupling comprising:

a first member having first and second opposite ends and having a first engagement portion toward the first end, the first engagement portion having a first engagement surface rounded convexly away from the second end with a portion of the first engagement surface furthest from the second end aligned with a first axis, the first member capable of axial motion along the first axis extending between and beyond the first and second ends and being piloted toward the first and second ends thereof for motion along the first axis;

a second member having first and second opposite ends and capable of axial motion along a second axis substantially coaxial with the first axis extending between and beyond the first and second ends of the second member, the second member being piloted toward the first and second ends thereof for motion along the second axis, the second member having a second engagement portion toward the second end with a substantially flat second engagement surface in contact with the portion of the first engagement surface furthest from the second end of the first member to align motion of the first member along the first axis with motion of the second member along the second axis, one of the first and second members being coupleable to a drive mechanism of the ultra-high pressure pump to impart a reciprocating motion to the other of the first and second members.

9. The coupling of claim 8 wherein the second engagement portion is substantially perpendicular to the first axis.

10. The coupling of claim 8 wherein a portion of the first engagement surface extending furthest from the first end of the first member is aligned with the first axis.

11. The coupling of claim 8 wherein at least a portion of the first engagement surface is spherical.

12. The coupling of claim 8 wherein the first engagement portion of the first member is removably coupled thereto.

13. The coupling of claim 8 wherein the engagement portion of the first member includes a bearing member having an attachment portion extending at least partially around the first member and removably connected to the first member toward the first end, the first engagement surface being a surface of the bearing member extending beyond the first end.

14. The coupling of claim 8 wherein the second engagement portion of the second member is removably coupled thereto.

15. The coupling of claim 8 wherein the second member has an annular bore having a bore opening and extending into the second end along the second axis and the second engagement portion includes a bearing member removably positioned within the annular bore, the second engagement surface being a surface of the bearing member facing the bore opening.

16. The coupling of claim 15 wherein the bore and the bearing member have circular cross-sectional shapes.

17. The coupling of claim 8 wherein at least one of the first and second engagement portions is biased toward the other of the first and second engagement portions with a biasing member.

18. The coupling of claim 17 wherein the biasing member includes a coil spring biasing the first engagement portion toward the second engagement portion.

19. A coupling for transmitting linear motion in an ultra-high pressure pump, the coupling comprising:

a plunger member having first and second opposite ends, elongated along and capable of axial motion along a first longitudinal axis extending between and beyond the first and second ends, the second end being piloted along the first longitudinal axis and extending into a cylinder to generate ultra-high pressures therein when the plunger member is reciprocated along the first longitudinal axis;

a rod member having first and second opposite ends, elongated along and capable of axial motion along a second longitudinal axis extending between and beyond the first and second ends of the rod member and being substantially coaxial with the first axis, the rod member being piloted toward the second end thereof along the second longitudinal axis, the rod member and plunger member being piloted relative to each other toward the first ends thereof, the second end of the rod member having an aperture extending therein substantially along the second longitudinal axis, the first end of the rod member being coupled to a drive mechanism of the ultra-high pressure pump to impart a reciprocating motion to the plunger member;

a plunger bearing member coupled to the plunger member toward the first end and having a first bearing surface facing away from the plunger member, a rod bearing member positioned at least partially within the aperture of the rod member and having a second bearing surface configured to engage the first bearing surface of the plunger bearing, one of the first and second bearing surfaces being convex and the other of the first and second bearing surfaces being substantially flat to transmit reciprocating linear motion between the rod member and the plunger member.

20. The coupling of claim 19 wherein the plunger bearing member is removably coupled to the plunger member.

21. The coupling of claim 19 wherein the rod bearing member is removably coupled to the rod member.

22. The coupling of claim 19 wherein the first bearing surface is substantially flat and substantially perpendicular to the second longitudinal axis and the second bearing surface is at least partially spherically convex and has a center of curvature positioned substantially on the second longitudinal axis.

23. The coupling of claim 19 wherein the second bearing surface is substantially flat and substantially perpendicular to the first longitudinal axis and the first bearing surface is at least partially spherically convex and has a center of curvature positioned substantially on the first longitudinal axis.

24. The coupling of claim 19 wherein the rod member and plunger member are attached to each other.

25. The coupling of claim 19 wherein the rod member and the plunger member are threadably attached to each other.

26. The coupling of claim 19, further comprising a biasing device biasing at least one of the first and second bearing members toward the other of the first and second bearing members.

27. The coupling of claim 26 wherein the biasing device includes a coil spring coupled to the first bearing member to bias the first bearing member toward the second bearing member.

28. A high pressure fluid seal assembly for use in an ultra-high pressure pump comprising:

a seal carrier having a bore therethrough and having a first annular groove concentric with the bore and a second annular groove concentric with the bore and axially spaced from the first annular groove;

an annular seal positioned in the first annular groove, an end region of the seal being supported by the seal carrier;

an annular guidance bearing positioned in the second annular groove, an inner diameter of the annular guidance bearing being smaller than an inner diameter of the bore of the seal carrier in a region between the first annular groove and the second annular groove;

a first member extending through the bore, having first and second opposite ends, elongated along a first longitudinal axis extending between and beyond the first and second ends and having a first engagement portion toward the first end, the first engagement portion having a first engagement surface rounded convexly away from the second end with a portion of the first engagement surface furthest from the second end aligned with the first longitudinal axis, the first member being piloted toward the first and second ends thereof for motion along the first longitudinal axis;

a second member having first and second opposite ends, elongated along a second longitudinal axis extending between and beyond the first and second ends of the second member, the second longitudinal axis being substantially coaxial with the first longitudinal axis, the second member being piloted toward the first and second ends thereof for motion along the second longitudinal axis, the second member having a second engagement portion toward the second end with a substantially flat second engagement surface in contact with the first engagement surface of the first member and substantially perpendicular to the first longitudinal axis to align motion of the first member along the first longitudinal axis with motion of the second member along the second longitudinal axis, wherein at least one of the first and second engagement portions is biased toward the other of the first and second engagement portions with a biasing member.

29. The fluid seal of claim 28 wherein the biasing member includes a coil spring biasing the first engagement member toward the second.

30. A coupling for transmitting linear motion in an ultra-high pressure pump, the coupling comprising:

a first member having first and second opposite ends and having a first engagement portion toward the first end, the first engagement portion having a first engagement surface rounded convexly away from the second end with a portion of the first engagement surface furthest from the second end aligned with a first axis, the first member capable of axial motion along the first axis extending between and beyond the first and second ends and being piloted toward the first and second ends thereof for motion along the first axis;

a second member having first and second opposite ends and capable of axial motion along a second axis substantially coaxial with the first axis extending between and beyond the first and second ends of the second member, the second member being piloted toward the first and second ends thereof for motion along the second axis, the second member having a second engagement portion toward the second end with a substantially flat second engagement surface in contact with the first engagement surface of the first member to align motion of the first member along the first axis with motion of the second member along the second axis, one of the first and second members being coupleable to a drive mechanism of the ultra-high pressure pump to impart a reciprocating motion to the other of the first and second members, wherein at least one of the first and second engagement portions is biased toward the other of the first and second engagement portions with a biasing member.

31. The coupling of claim 30 wherein the biasing member includes a coil spring biasing the first engagement portion toward the second engagement portion.

* * * * *